US010696041B2

(12) United States Patent
Palme et al.

(10) Patent No.: US 10,696,041 B2
(45) Date of Patent: Jun. 30, 2020

(54) METHOD AND DEVICE FOR OPERATING A ROTARY SCREEN-PRINTING MACHINE

(71) Applicant: KOENIG & BAUER AG, Würzburg (DE)

(72) Inventors: Martin Palme, Kist (DE); Vincent Ruchti, Préverenges (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/487,499

(22) PCT Filed: Sep. 22, 2017

(86) PCT No.: PCT/EP2017/074032
§ 371 (c)(1),
(2) Date: Aug. 21, 2019

(87) PCT Pub. No.: WO2018/153509
PCT Pub. Date: Aug. 30, 2018

(65) Prior Publication Data

US 2020/0055306 A1 Feb. 20, 2020

(30) Foreign Application Priority Data

Feb. 23, 2017 (DE) ..... 10 2017 202 941

(51) Int. Cl.
*B41F 13/34* (2006.01)
*B41F 15/08* (2006.01)
(Continued)

(52) U.S. Cl.
CPC ..... *B41F 15/0809* (2013.01); *B41F 11/02* (2013.01); *B41F 13/26* (2013.01);
(Continued)

(58) Field of Classification Search
CPC .. B41F 15/0836; B41F 15/0809; B41F 15/42; B41F 15/44; B41F 15/423; B41F 13/32;
(Continued)

(56) References Cited

U.S. PATENT DOCUMENTS 7,677,171 B2 3/2010 Schaede
10,040,276 B2 8/2018 Sakata
(Continued)

FOREIGN PATENT DOCUMENTS

DE 102015208919 A1 11/2016
EP 1582349 A1 10/2005
(Continued)

OTHER PUBLICATIONS

International Search Report of PCT/EP2017/074032 dated Dec. 11, 2017.

*Primary Examiner* — Leslie J Evanisko
(74) *Attorney, Agent, or Firm* — Mattingly & Malur, PC

(57) ABSTRACT

A screen-printing unit in a printing machine comprises a screen cylinder which carries a screen-printing stencil and in which a squeegee is moved, from the inside, into contact with, and away from the screen-printing stencil. The screen cylinder is moved into contact with an impression cylinder, such that a printing position is formed, and is moved away therefrom, such that a gap is formed. The screen cylinder is moved away from the impression cylinder, in a first phase, when the squeegee is in a non-contacting position. In a second phase, at least one sheet of printing material is passed through the printing position when the squeegee continues to be in a non-contacting position and the screen cylinder is at least temporarily in a contacting position. For subsequent sheets of printing material, in a third phase, the screen-printing unit is operated with the squeegee one of permanently and cyclically, such as at least once for each sheet of printing material, in a contacting position.

16 Claims, 9 Drawing Sheets

(51) Int. Cl.

| | |
|---|---|
| ***B41F 33/08*** | (2006.01) |
| ***B41F 11/02*** | (2006.01) |
| ***B41F 15/44*** | (2006.01) |
| ***B41F 15/42*** | (2006.01) |
| ***B41F 13/26*** | (2006.01) |

(52) U.S. Cl.
CPC ..... *B41F 15/0836* (2013.01); *B41F 15/423* (2013.01); *B41F 15/44* (2013.01)

(58) Field of Classification Search
CPC ..... B41F 13/26; B41F 13/34; B41F 33/06; B41F 33/08; B41F 33/12; B41F 33/14; B41F 33/10; B41P 2233/10
See application file for complete search history.

(56) References Cited

U.S. PATENT DOCUMENTS

| | | | |
|---|---|---|---|
| 2007/0193462 | A1 | 8/2007 | Schaede |
| 2009/0178582 | A1 | 7/2009 | Dal Pont |
| 2017/0341366 | A1 | 11/2017 | Sakata |
| 2017/0348963 | A1 | 12/2017 | Booth et al. |

FOREIGN PATENT DOCUMENTS

| | | | |
|---|---|---|---|
| EP | 3210777 | A1 | 8/2017 |
| WO | 2007/119167 | A2 | 10/2007 |
| WO | 2016102187 | A1 | 6/2016 |

METHOD AND DEVICE FOR OPERATING A ROTARY SCREEN-PRINTING MACHINE

CROSS REFERENCE TO RELATED APPLICATIONS

This application is the U.S. National Phase, under 35 U.S.C. § 371, of PCT/EP2017/074032, filed Sep. 22, 2017; published as WO 2018/153509 A1 on Aug. 30, 2018, and claiming priority to DE 10 2017 202 941.2, filed Feb. 23, 2017, the disclosures of which are expressly incorporated herein in their entireties by reference.

FIELD OF THE INVENTION

The present invention relates to a method and a device for operating a screen printing press. A screen printing unit in the screen printing press includes a screen cylinder which carries a screen printing forme and in which screen cylinder, a squeegee can be engaged, from the inside, against the screen printing forme and can be disengaged therefrom. The screen cylinder can be thrown onto an impression cylinder, such that a print position is formed, and can be thrown off of the impression cylinder such that a gap is formed. The squeegee can be engaged against the screen printing forme and can be disengaged from the screen printing forme by a first drive, and can be thrown, by a second drive, which is different from the first drive, onto an impression cylinder, such that a print position is formed, and can be thrown off of the impression cylinder, such that a gap is formed.

BACKGROUND OF THE INVENTION

WO 2016/102187 A1 discloses a rotary screen printing press having a first and a second screen cylinder, which form two print positions with an impression cylinder. Between the first and second print positions a radiation dryer is provided, directed toward the lateral surface of the impression cylinder. A squeegee located inside the screen printing cylinder can be engaged from the inside against the screen printing forme and disengaged from said printing forme by means of a drive, mechanically independently of the rotation of screen cylinder and impression cylinder.

DE 10 2015 208919 A1 discloses a screen printing unit having a screen cylinder that can be thrown onto and off of an impression cylinder, and a squeegee inside the screen cylinder that can be set against the screen and moved away therefrom.

EP 1582349 A1 discloses a method for printing by the screen printing method onto sheets conveyed by a chain conveyor, in which upon entering the print position, the gripper drawing the sheet is received by a channel on the circumferential surface by an impression cylinder, and is then positioned at the trailing end of the channel by the relative speed between chain conveyor and impression cylinder. During said positioning, squeegee and screen cylinder preferably remain thrown off of the impression cylinder. During this phase, squeegee and screen cylinder begin to move into the position required for printing. For printing, the screen cylinder is brought in contact with the impression cylinder and the squeegee is brought in contact with the screen.

The object of EP 3210777 A1 is to reduce waste sheets by printing onto even the first sheet of a production run. In conventional processes, in contrast, the squeegee is not placed in an engaged position until the thrown-on screen cylinder has completed a full revolution.

When the screen printing cylinder is thrown off, a lack of ink removal along with possible rotation may result in an undesirable build-up of ink on the outer surface of the screen, and when thick layers come into contact with the impression cylinder surface or during printing of the first sheets, this can ultimately lead to undesirable soiling of the impression cylinder. This effect is particularly adverse when an intermediate drying step is carried out by means of a dryer directed toward the lateral surface of the cylinder. This leads rapidly to a build-up of ink. During intermediate drying, in particular, the dried ink becomes hard, forming peaks, and can cause damage to the screen printing forme. Printing ink that is hardened in this way is very difficult to remove from the cylinder surface.

SUMMARY OF THE INVENTION

The object of the present invention is to provide an improved method and an improved device for operating a screen printing press.

The object is attained according to the invention by the operation of the screen printing press, in a first phase, in which the screen cylinder is thrown off of the impression cylinder while the squeegee is in a disengaged position. In a second phase, one or more printing substrate sheets are conveyed through the print position, while the squeegee remains in a disengaged position, and the screen cylinder is at least temporarily thrown on. In a third, final, phase, for subsequent printing of substrate sheets, an operation is carried out in which the squeegee is in an engaged position, one of perpetually or cyclically at least once for each printing substrate sheet. A control is provided, which control is connected, in terms of signals, to the first and second drives. After the first phase, in which the screen cylinder is thrown off of the impression cylinder and the squeegee is in a disengaged position, in the second phase, in which the squeegee is perpetually in a disengaged position during the passage of one or more printing substrate sheets through the print position, the control actuates the second drive to throw the screen cylinder on at least temporarily for each printing substrate sheet. In the subsequent third phase, for a number printing substrate sheets, the control actuates the first drive to engage the squeegee, from the inside, against the screen printing forme, one of perpetually or at least once for each printing substrate sheet.

The advantages to be achieved with the invention involve, in particular, a substantial reduction in the cost and effort of cleaning the impression cylinder and/or in the risk of damage to the screen printing forme. As a result of the throw-on sequence, printing ink that accumulates on the outer surface of the screen printing forme while the screen printing cylinder is thrown off is removed before the built-up ink can be distributed to unintended locations on the sheet and/or the impression cylinder as a result of the engagement of the squeegee. As a further advantage, the forcing through of printing ink can be reduced by lower operating speeds in the print-off stage.

BRIEF DESCRIPTION OF THE DRAWINGS

Exemplary embodiments of the present invention are illustrated in the set of drawings and will be described in greater detail below.

In the drawings.

DESCRIPTION OF THE PREFERRED EMBODIMENT

Figure 1:
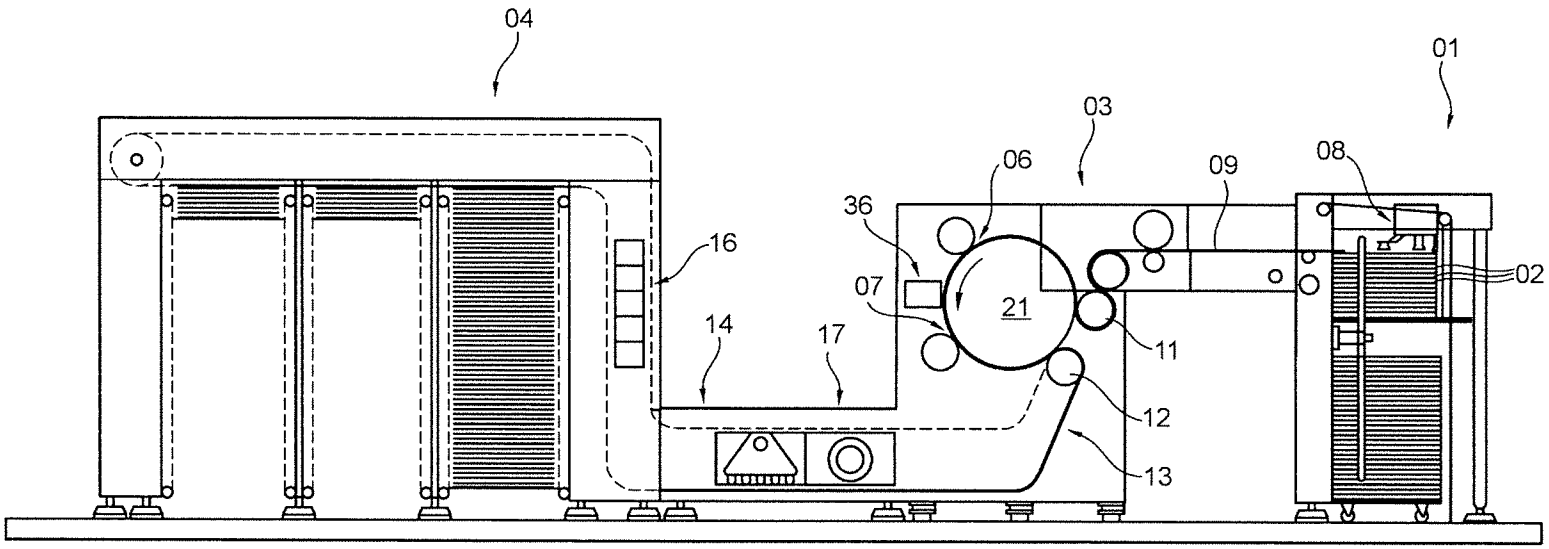
FIG. 1 shows an exemplary embodiment of a printing press comprising a printing assembly.

A printing press, e.g., a sheet-fed printing press or a web-fed printing press, comprises on the intake side an infeed device 01, which supplies the printing press with a sheet-format or web-format printing substrate 02, at least one printing assembly 03, with which the printing substrate 02 is printed one or more times on one side or on both sides, and a product delivery 04, where printed products or intermediate products are delivered in stacks or continuously, or are wound onto a roll (see, e.g., FIG. 1).

In a preferred embodiment illustrated in the figures, the printing press is embodied as a printing press for security printing, for example, for printing onto web-format printing substrate 02, e.g. a printing substrate web, or preferably for printing onto sheet-format printing substrate 02, e.g. printing substrate sheets 02. Infeed device 01 for the latter embodiment is configured, e.g., as a sheet feeder 01, in which a pile of the printing substrate sheets 02 to be fed in and imprinted can be arranged.

The printing assembly 03 of the printing press configured, e.g., as a security printing press is configured to print onto printing substrate 02 in the region of at least one print position 06; 07 on at least one side of the printing substrate in a screen printing process, in particular a rotary screen printing process. The printing substrate 02 to be printed on in the screen printing process is preferably embodied as printing substrate sheets 02 and/or as printing substrate 02 that has already been printed on in another printing process and/or as security paper comprising, e.g., textile, linen, hemp and/or synthetic fibers and/or as a plastic substrate (polymer substrate) or as a hybrid substrate.

Preferably, the printing press is embodied as a sheet-fed printing press for security printing, and is configured, e.g., to produce printed sheets, in particular security sheets, e.g. sheets containing banknotes, as products or as intermediate products to be further processed, from unprinted or preprinted sheets of printing substrate 02.

The printing substrate sheets 02 are held in reserve, e.g., as layers of a pile of printing substrate, in the infeed device 01 configured as a sheet feeder 01, from which said sheets are picked up individually by a gripping device 08, not shown in detail and comprising, e.g., suction cups, and are conveyed separately along a conveyor line 09, e.g. via a conveyor system 09, preferably configured as a belt system 09, and optionally via a feed drum, up to an intake area into the printing assembly 03. At the intake into printing assembly 03, for example, at a transfer drum 11, printing substrate sheet 02 is transferred to a conveyor line associated with printing assembly 03, e.g., to a conveyor system associated with printing assembly 03, along the transport path of which printing substrate sheet 02 passes through one or more print positions 06; 07 before entering a third conveyor line 13, for example via a receiving drum 12, from the conveyor line associated with printing assembly 03, or before being transferred to a third conveyor line 13, e.g., a belt system 13, and transported by said conveyor line to product delivery 04, e.g., to a product delivery 04 comprising one or more sheet delivery units for pile formation.

In the case of a web-processing embodiment of the printing press, in the area of printing assembly 03 the web-format printing substrate 02 passes along a conveyor line that comprises one or more rollers and/or cylinders wrapped by the web.

In the preferred embodiment of the printing press as a sheet-processing printing press, the conveyor line associated with printing assembly 03 is preferably configured as a gripper system, in which printing substrate sheet 02 is conveyed by successive transfers between a plurality of drums and/or cylinders in succession in the direction of transport along the transport path through printing assembly 03. At the end of the conveyor line configured, e.g., as a gripper system, printing substrate sheet 02 is delivered to the third conveyor line 13.

In the printing substrate path downstream of printing assembly 03, one or more conditioning devices 14; 16; 17, for example one or more drying units 14; 16, e.g., a first drying unit 14 and an additional drying unit 16, and/or a device 17 for exposing printing substrate 02 to directed magnetic field lines may be provided.

On at least one side of the conveyor line, printing assembly 03 comprises at least one print position 06, by means of which one of the sides of printing substrate 02 is or can be imprinted. Print position 06 may be formed by a nip point 06 between two rotational bodies 18; 21, e.g., a nip point 06 between a cylinder 18 of a first printing unit 19 and a cylinder 21 that serves as a counter bearing for said cylinder 18, e.g., an impression cylinder and/or transport cylinder 21.

Downstream of said at least one print position 06, a first rotational body 22, which is located downstream of print position 06 in the printing substrate path and is in physical contact with the side of the printing substrate that has been imprinted by the at least one print position 06, may be arranged in the printing substrate path of printing substrate 02, in particular in the conveyor line through printing assembly 03 that follows downstream of print position 06. This rotational body 22, which cooperates with the freshly printed side of the printing substrate, may be embodied, e.g., as a guide roller and/or transport roller in the conveyor system, as a conditioning roller for cooling or heating the printing substrate 02, or as a cylinder 22 of a printing unit 23 that follows the former printing unit 19, in particular so as to form an additional print position 07.

A second print position 07 of this type may be formed in this case by a nip point 07 between cylinder 22 of the second printing unit 23 and a cylinder that acts as a counter bearing and that is formed, e.g., by the cylinder 21 that serves as an impression cylinder and/or transport cylinder 21 in first printing unit 19, or by an additional cylinder, different therefrom, that acts as an impression cylinder and/or transport cylinder. One or more additional printing units of this type that act on this same side of the printing substrate, and/or one or more additional printing units that act on the other side of the printing substrate may also be provided upstream or downstream in the printing substrate path of the printing press and/or of printing assembly 03.

Figure 2B:
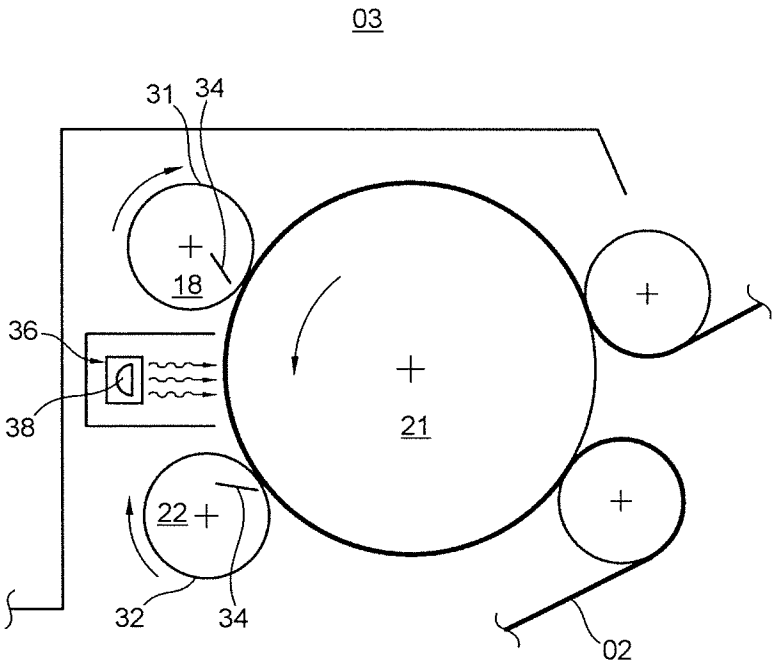
FIG. 2*b* shows an enlarged, detailed diagram of the exemplary embodiment of a printing assembly of FIG. 1 in a web processing embodiment.
Figure 2A:
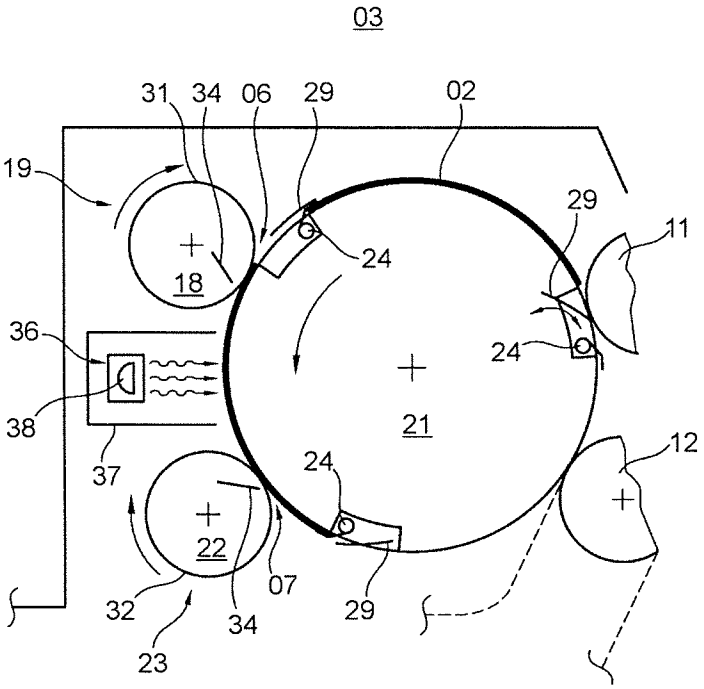
FIG. 2*a* shows an enlarged, detailed diagram of the exemplary embodiment of a printing assembly of FIG. 1 in a sheet processing embodiment.

In the preferred embodiment of the printing press as a sheet-processing printing press, the at least one impression cylinder and/or transport cylinder 21 comprises at least one holding device 24 on its peripheral surface, preferably a plurality of such holding devices, e.g., three, arranged one behind the other, e.g., a gripper device 24 comprising one gripper or a group of multiple grippers, by means of which the leading end of a printing substrate sheet 02 can be picked up on the intake side and can be delivered to the conveyor line downstream on the output side. Gripper device 24 in this case is located, e.g., in a pit 26 provided in the otherwise cylindrical lateral surface 27 of cylinder 21, with the radially outwardly directed opening 28 of said pit, e.g., pit opening 28, interrupting and disrupting the cylindrical shell-shaped lateral surface 27 (see, e.g., FIG. 2*a*)).

For a web-processing embodiment of the printing press, such holding devices 24 can be dispensed with (see, e.g., FIG. 2*b*)). In general terms, the n-sized cylinder 21 comprises n copies, i.e., n circumferential sections $U_D$ that are usable without interruption for printing.

Regardless of the type and the number n of holding devices 24 that are provided in the circumferential direction in the case of sheet printing, a break in the otherwise undisrupted, cylindrically shaped lateral surface 27 is caused by the respective pit opening 28 on the circumferential surface of the impression cylinder and/or transport cylinder 21.

In an n-sized, i.e. a single-circumference or multiple-circumference embodiment, impression cylinder and/or transport cylinder 21, as viewed in the circumferential direction, comprise(s) n, i.e., one or more circumferential sections $U_D$, in particular cylinder circumferential sections $U_D$, which are usable as a counter bearing during printing, and n, i.e., one or more circumferential sections $U_N$, in particular cylinder circumferential section $U_N$ having a disrupted lateral surface 27, which comprise(s) holding devices 24 and are not usable as a counter bearing during printing. The circumferential sections $U_D$ that are usable as a counter bearing during printing are also referred to colloquially as "saddles".

The circumferential section $U_N$ that comprises opening 28 and is not suitable and/or intended for printing has an effective rolling length $L_N$ along the continued circumferential line that is equivalent to the length of the arc that extends over the opening. The circumferential section $U_N$ that is usable for printing therefore has a length $L_N$ that at the same time limits the maximum potential printing image length $L_B$.

The circumferential section $U_N$ that is not usable as a counter bearing for printing may, in principle, be formed solely by opening 28 of pit 26 that accommodates holding device 24, or optionally by said opening 28 and, if provided, by a functional section that adjoins said opening on the leading and/or the trailing side, for example an overlap area of an inking aid 29 optionally provided on the leading side (see below), and/or a spacing from the trailing edge of the pit opening that follows it, to be maintained by fixation. Conversely, the circumferential section $U_D$ that is usable for printing may, in principle, be formed by the cylinder surface section between a leading end of the break, for example, the leading end of opening 28, and the trailing end of the same opening 28 or the next opening that follows in the circumferential direction. If the contour that delimits the disruption in lateral surface 27 on the leading and/or the trailing side is irregular in shape, the length $L_N$ of the circumferential section $U_N$ that is not usable for printing is understood, for example, as the arc length, as viewed in the circumferential direction, between the first point on the leading side and the last point on the trailing side of the break in the undisrupted lateral surface 27 attributed to the same holding device 24.

The at least one printing unit 19 and in particular also the at least one additional printing unit 23 that cooperates with the same side of the printing substrate is configured as a printing unit 19; 23 that operates by the screen printing process, more succinctly as a screen printing unit 19; 23, and the cylinder 18; 22 assigned to printing unit 19; 23 is configured as a forme cylinder 18; 22, more particularly as what is known as a screen cylinder 18; 22, in particular as a screen printing cylinder 18; 22.

Screen cylinder 18; 22 rolls along the lateral surface of the impression cylinder and/or transport cylinder 21, and in the region of its aforementioned nip point 06; 07 with the impression cylinder and/or transport cylinder 21 forms print position 06; 07. In the region of its lateral surface, screen cylinder 18; 22 comprises a screen printing forme 31; 32, in particular screen printing stencil 31; 32, as a printing forme 31; 32, arranged concentrically to the real or imaginary cylinder axis. In the mounted state, said forme is detachably fastened at its end face, for example, to ring flanges (not shown). Screen printing stencil 31; 32 may be embodied, in principle, as a continuous screen printing stencil in the shape of a cylindrical shell or sleeve, or as a finite screen printing stencil 31; 32 which, in the mounted state, is nevertheless circumferentially closed, forming a small butt joint.

Figure 9:
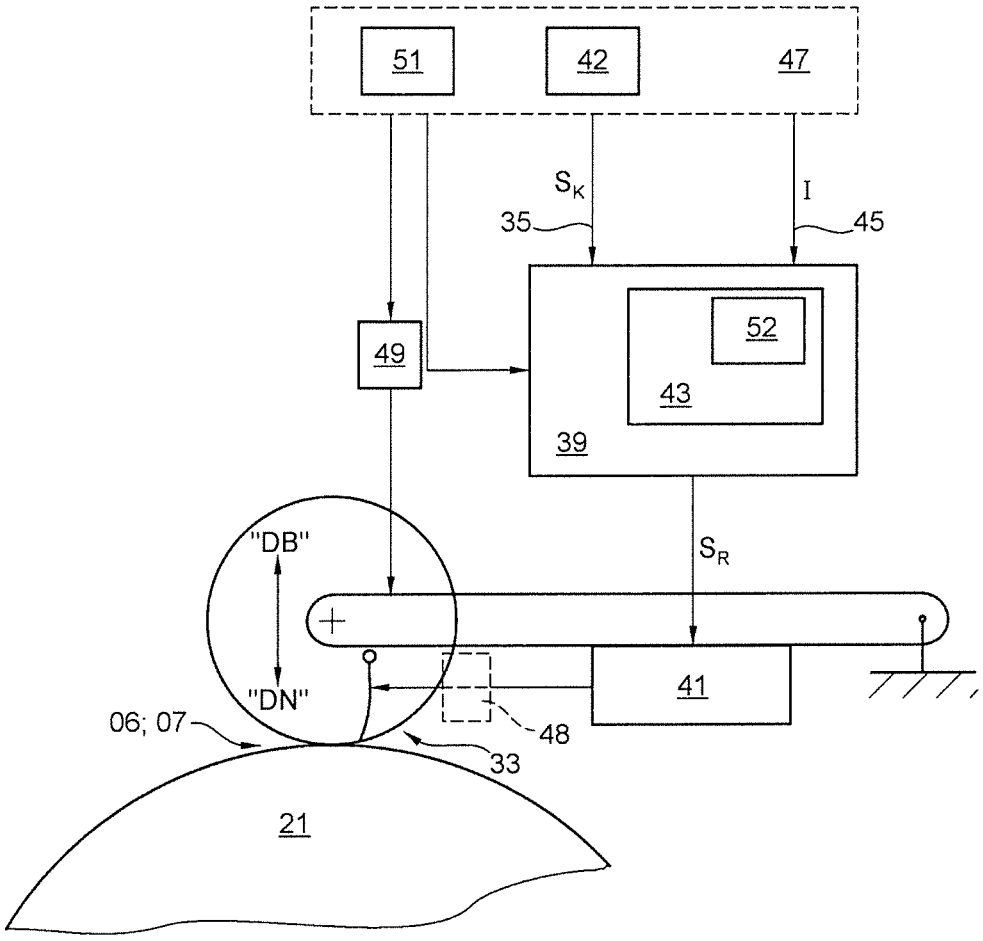
FIG. 9 shows a schematic diagram of a squeegee device comprising a drive device and a control device.
Figure 10:
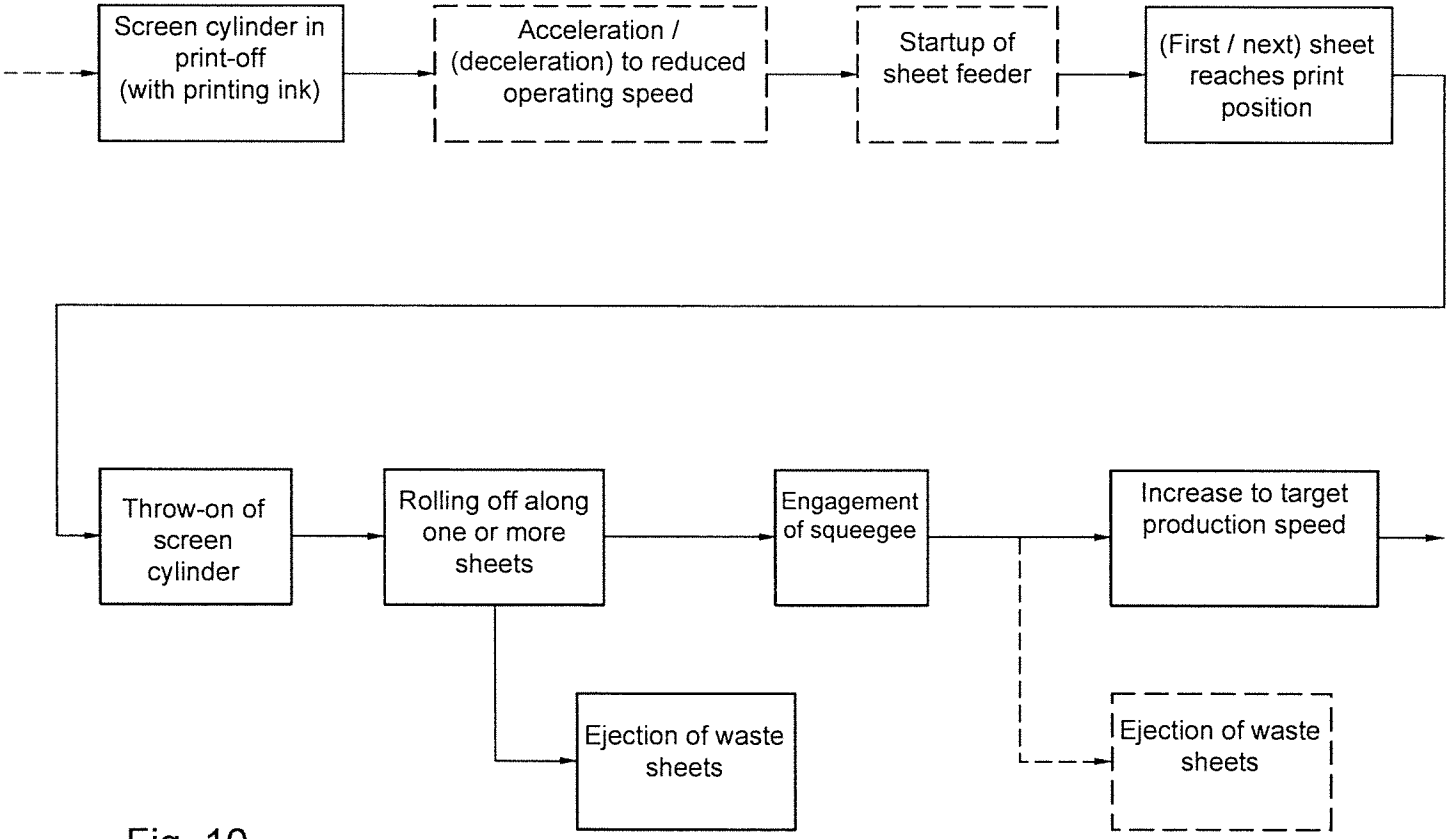
FIG. 10 shows a schematic diagram illustrating the operation of a screen printing unit following an interruption in production.
Figure 11:
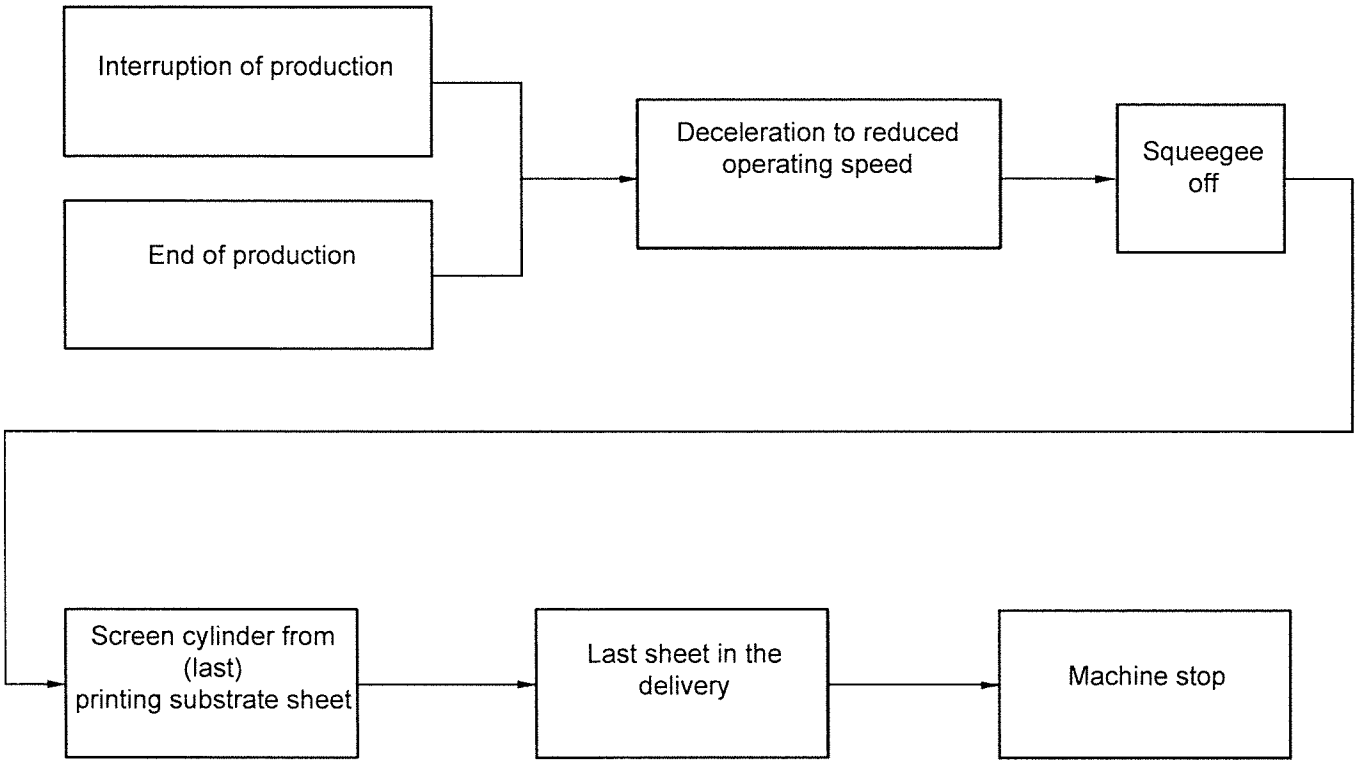
FIG. 11 shows a schematic diagram illustrating the shutting down of a screen printing unit in the case of an error-induced interruption in production.

Inside forme cylinder 18; 22, a squeegee 34 of a squeegee device 33, e.g., illustrated schematically in FIG. 9, is provided, which in an engaged position "ON" is set from the inside against the screen printing stencil 18, in a circumferential region of screen cylinder 18; 22 in which said cylinder forms print position 06; 07 with the impression cylinder and/or transport cylinder 21. This position may be formed, for example, a maximum of 5° in front of or behind the nip point 06; 07 with impression cylinder and/or transport cylinder 21, in relation to the operational direction of rotation. When squeegee 34 is engaged in this manner, it accumulates a bead of printing ink, which it rolls in front of itself and forces through the permeable areas of screen printing stencil 31; 32 to the outside.

To enable the quickest possible return for printing in the subsequent circumferential section $U_D$ once the aforementioned opening 28 in impression cylinder and/or transport cylinder 21 has passed through nip point 06; 07, an aforementioned inking aid 29, e.g., a covering element 29 configured as a flap 29 for the temporary and at least partial covering of opening 28 may be provided, by means of which the opening 28 can be temporarily covered, at least in the leading area of opening 28. This enables the squeegee 34, which is lifted off during the passage of the open area of opening 28 through the nip point, for example, to be engaged early. Covering element 29 may overlap slightly with the uninterrupted section of the cylinder lateral surface, for example, and in that case shortens the length $L_D$ of the maximum circumferential section $U_D$ that is usable for printing. This geometric shortening is more than offset, e.g., by early engagement of the squeegee. With early engagement, the beginning of a printing area on the leading side, with respect to the rolling movement during operation, can ideally be positioned immediately adjacent to covering element 29, but may also be positioned a slight stand-off distance therefrom. A lengthening of the circumferential section $U_N$ that is not usable for printing beyond the leading edge of the opening, said lengthening resulting from the slight overlap, for example, and optionally from a slight stand-off distance following covering element 29, and/or the distance between the earliest possible beginning of the printing area and the trailing edge of the opening may be between 10 mm and 50 mm, for example, and is preferably no more than 30 mm.

Figure 3:
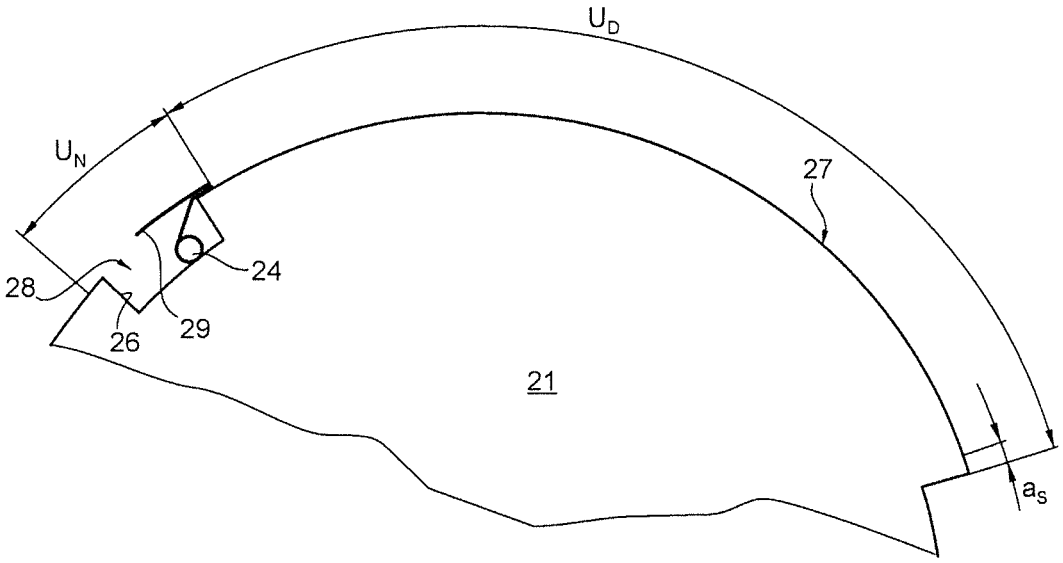
FIG. 3 shows a schematic cross-sectional diagram of an impression cylinder segment and/or transport cylinder segment.
Figure 4:
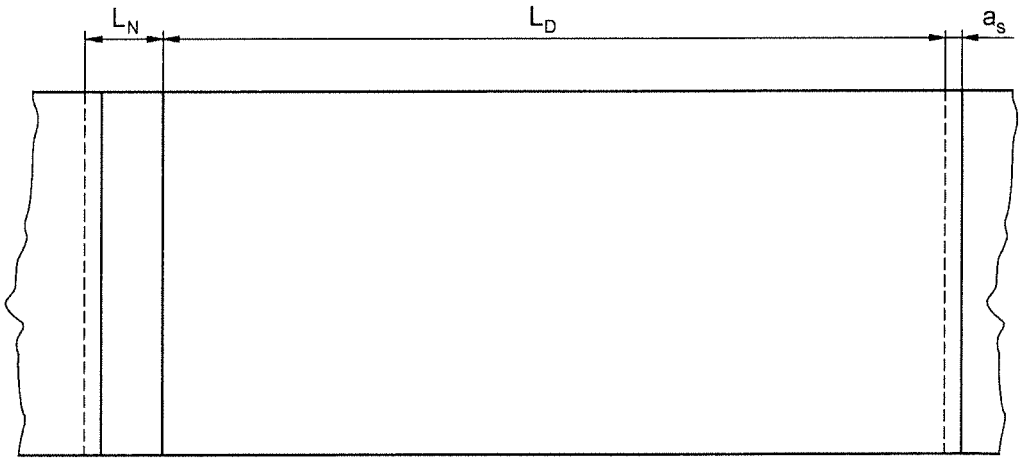
FIG. 4 shows a schematic diagram of an unrolled lateral surface segment of the impression cylinder and/or transport cylinder.

The maximum length $L_D$ that is usable for printing is limited by the earliest possible beginning of the printing area, determined by the press and/or by safety considerations, and the latest possible end of the printing area on the trailing side, determined by the press and/or by safety considerations. In principle, the latest possible end of the printing area may coincide with the leading end of the subsequent opening 28, e.g., the leading opening edge of the subsequent opening 28, or, e.g., for reasons of safety and/or a risk of soiling and/or the length of a throw-off phase $P_{off}$, mentioned below, may be spaced by a distance as to be maintained from the trailing edge of the subsequent pit opening (see, e.g., as schematically illustrated in FIG. 3 and FIG. 4). The maximum length $L_D$ that is usable for printing may be limited, for example, by the length of the uninterrupted circumference of the counter bearing, e.g., the impression cylinder and/or transport cylinder 21, or by other press elements that are involved in printing and/or transport, or by the maximum length that is usable for printing, as viewed in the transport direction and/or circumferential direction, of the printing formes 31; 32 provided for the printing unit 19; 23, in the following also referred to as the printing length. These sizes are typically coordinated with one another and correspond substantially to one another.

In a single-circumference embodiment of impression cylinder and/or transport cylinder 21, the subsequent pit opening 28 is understood as the same single pit opening 28.

In the preferred embodiment, between the at least one print position 06 and the point downstream in the printing substrate path at which the side of printing substrate 02 that has been printed on by print position 06 comes in contact with the subsequent rotational body 22, an additional drying unit 36, e.g., a dryer 36, in particular an interdeck dryer 36, is provided, which is preferably configured as a radiation dryer 36. To create an active zone for dryer 36 that is spatially narrowly delimited along the printing substrate path, a shade 37 that restricts the radiation upstream and/or, in particular, downstream may be provided, said shade being provided, for example, by a wall 37 of a housing that accommodates dryer 36 and is open toward the side of the printing substrate 02. In the embodiment configured as a radiation dryer 36, said dryer comprises a single-part or multi-part radiation source 38 for electromagnetic radiation, e.g., for light, in particular for UV light, i.e., light for which at least the largest proportion of emitted radiant output lies in the UV spectral range. In particular, dryer 36 may be embodied as a UV-LED dryer.

Squeegee device 33 (see, for example, as shown schematically in FIG. 2 and FIG. 9) comprises a bearing device for squeegee 34 that enables an engaging and disengaging movement, and a drive device 39, 41, 48, by means of which the squeegee edge of squeegee 34 is or can be set against and moved away from screen printing stencil 31; 32 of screen printing cylinder 18; 22 during operation in cyclic correlation, in particular synchronized or clocked, to the rotational position of impression cylinder and/or transport cylinder 21, and/or in cyclic correlation, in particular clocked, to the position of printing substrate 02 to be printed, as viewed in the transport direction, at least as said correlation relates to the length and/or position of an engagement and disengagement sequence based on the cycle length $L_Z$, having at least one phase or sequence $P_{ON}$ relating to an engaged position "ON" and at least one phase or sequence $P_{OFF}$ relating to a disengaged position "OFF". The correlation of the squeegee movement refers in general terms to a direct or indirect correlation to the press and/or printing substrate phase position, i.e., for example, to the position and/or movement of a press phase, in particular to a phase position relating to the print position 06; 07, and/or to a position and/or a feed rate of the printing substrate 02 in the printing press. This press phase may be determined through the directly or indirectly derived angular position of one of the cylinders 18; 21; 22 that forms the relevant print position 06; 07. The variable that relates to the feed rate of printing substrate 02 may be determined through an angular position signal of a press element that transports printing substrate 02 in a manner true to register or through a passage signal from a sensor system provided along the transport path.

The cycle length $L_Z$ is preferably determined by the repeat length between two sequential print sections, i.e., the shortest possible distance between the leading ends of two sequential printing image lengths. Depending upon the physical variable in question, said variable may relate spatially to a path length between two locations y or to an angle □, or in temporal terms to the interval between two points in time t. Factoring in the geometry and the transport speed profile, these variables can then be converted to one another and placed, for example, in a relative position to the press phase. The cycle length $L_Z$ is equal to the sum of the length L44 of a maximum circumferential section $U_D$ that is usable for printing, as viewed along the transport path, and the length $L_N$ of a circumferential section $U_N$ that lies between two such circumferential sections $U_D$ and is not usable for printing. In the case of sheet-fed printing, the latter may be dependent, inter alia, on the means for transporting sheets, for example, and in the case of web-fed printing, it may be dependent, inter alia, on interruptions caused by butt joints or even gaps between the ends of mounted printing formes. If an impression cylinder and/or transport cylinder 21 is provided, the cycle length $L_Z$ is equal overall, for example, to the sum of the length L44 of a circumferential section $U_D$ that is usable for printing and the length $L_N$ of a circumferential section $U_N$ that is not usable for printing, and/or the nth fraction of the circumference of the n-circumference or n-saddle-comprising impression cylinder and/or transport cylinder 21.

Such a cycle length $L_Z$, or the engagement/disengagement sequence associated with it, comprises, e.g., at least one phase $P_{OFF}$, in which squeegee 34 is disengaged, and at least one phase $P_{ON}$, in which squeegee 34 is engaged. Here again, the concept of phases $P_{OFF}$; $P_{ON}$ may refer to a spatial or to a temporal variable. Such a cycle may comprise a sequence having only a single phase $P_{OFF}$, in which squeegee 34 is disengaged, and a phase $P_{ON}$, in which squeegee 34 is engaged, or in a refinement, may also comprise a sequence having a plurality of phases $P_{ON}$, in which squeegee 34 is engaged, with these phases being separated from one another by a phase $P_{OFF}$, in which squeegee 34 is disengaged. Because the speed of movement as squeegee 34 is being engaged and disengaged is restricted, an engaged phase $P_{on}$ or a disengaged phase $P_{off}$ may be placed between the phase $P_{ON}$, during which squeegee 34 is engaged in its actual working position, in which the squeegee is set, for example, not merely directly up to and against screen printing stencil 31; 32, but with a slight deflection of, e.g., at least 0.5 mm, i.e., a negative distance $a_{ON}$ of $a_{ON} \leq -0.5$ mm, determined by the measure of the actuating movement beyond the initial physical contact, and the phase $P_{OFF}$ during which squeegee 34 is effectively disengaged, in which the squeegee edge is positioned a slight distance $a_{OFF}$ of, e.g., $a_{OFF} \geq 0.2$ mm, in particular 1.2 mm$\geq a_{OFF} \geq$0.4 mm, from screen printing stencil 31; 32.

To minimize the indistinct area between the actual engaged position "ON" and the actual disengaged position "OFF" and/or the area that is not usable for printing, while nevertheless enabling high operating speeds without excessively strong pulses induced by the movement of the squeegee, the length of the engagement phase $P_{on}$ and/or of the disengagement phase $P_{off}$, e.g., in relation to the screen printing stencil 31; 32 in the circumferential direction on the inner circumferential surface, is, e.g., between 80 mm and 200 mm, in particular between 110 mm and 150 mm. However, the sum of the length of a disengagement phase $P_{off}$ and the length of an engagement phase $P_{on}$ is equal, for example, at most to the length $L_N$ of the circumferential section $U_N$ that is not usable for printing, which in this case is determined, for example, at least by the width of opening 28, as viewed in the circumferential direction, and by the distance as upstream of the trailing pit edge, and if applicable by the length of the aforementioned overlap of an optionally provided covering element 29.

Figure 5A:
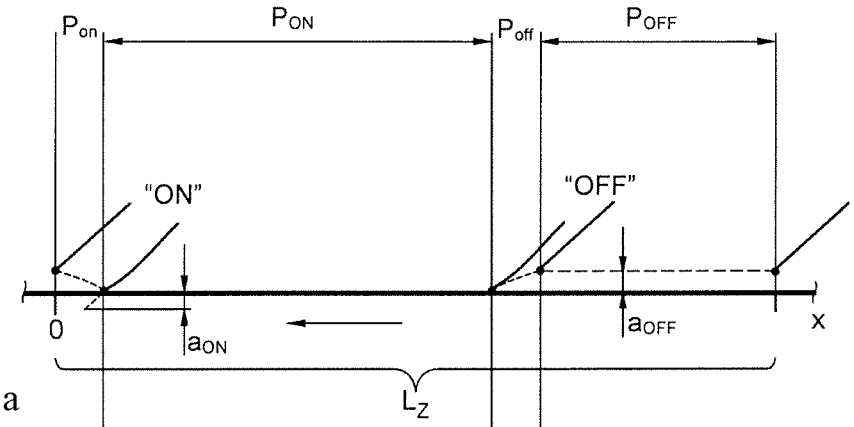
FIG. 5*a* shows a schematic diagram of the series of phases in a throw-on and throw-off sequence.
Figure 5B:
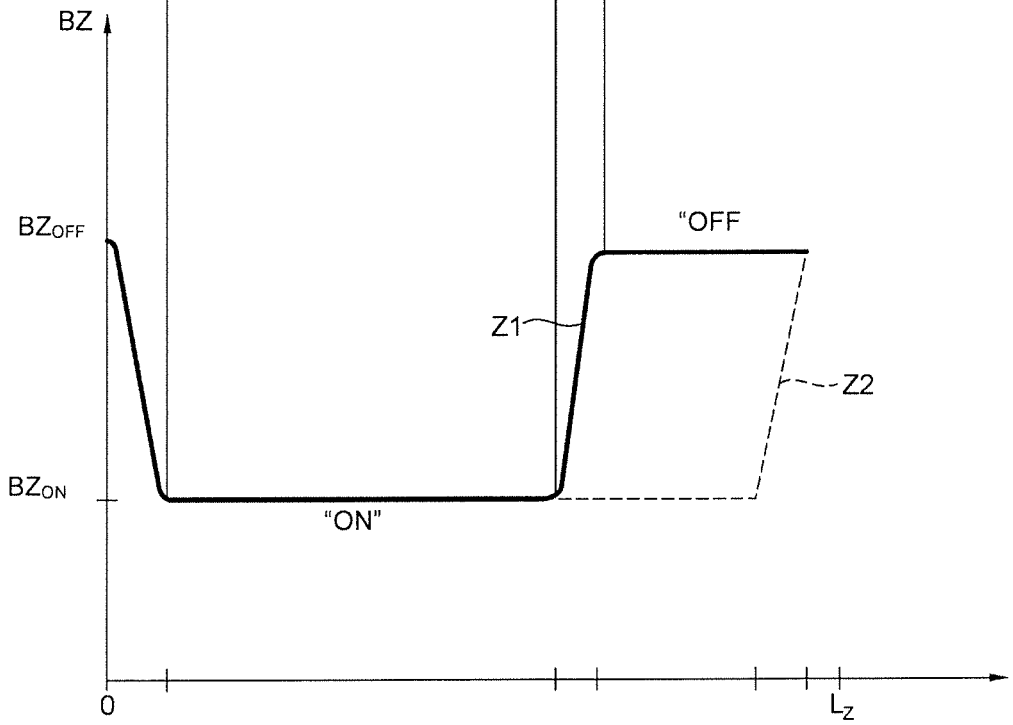
FIG. 5*b* shows a schematic diagram of the associated operating modes relating to the drive.

Squeegee device 33 comprises (see, e.g., FIG. 9) a control device 39, by means of which squeegee 34 is or can be engaged and disengaged in the aforementioned correlation to the press phase of the printing press and/or to the feed rate of printing substrate 02. In particular, control device 39 can be used to actuate a drive means 41 that brings about the engaging and disengaging movement of squeegee 34 in the aforementioned correlation to the press phase of the printing press and/or to the feed rate of printing substrate 02, in such a way that squeegee 34 is located alternatingly in the engaged position "ON" for a period of time that corresponds to the length of the phase $P_{ON}$, in which squeegee 34 is engaged, and, in particular following a transition phase that is dependent upon the time required for the phase change, in the disengaged position "OFF" for a period of time that corresponds to the length of the phase $P_{OFF}$, in which squeegee 34 is disengaged. For this purpose, drive means 41 is controlled by control device 39 in such a way that, during the phase $P_{ON}$, in which squeegee 34 is engaged, or for the corresponding time interval TON, the drive device is in an operating state $BZ_{ON}$ that brings about the engaged position "ON", and during the phase $P_{OFF}$, in which with squeegee 34 is disengaged, or for the corresponding time interval, the drive device is in an operating state $BZ_{OFF}$ that brings about the disengaged position "OFF" (see, e.g., as schematically illustrated in FIG. 5).

Control device 39 may be configured in this case as an integrated or distributed control circuit 39 or as an integrated data processing means or as distributed data processing means 39 that are in signal communication with one another, and comprises switching and/or data processing means for carrying out a correlation as described above. Control device 39 may be wholly or partially integrated into a press control system that is connected in terms of control processes to other actuating means and/or drive means of the printing press, or may be wholly or partially provided expressly for controlling squeegee 34.

Said correlation of the sequence related to a cycle length $L_Z$ to the press phase and/or to the printing substrate feed rate is accomplished, e.g., by the transmission of signals $S_K$ that represent the press phase and/or the printing substrate feed rate via a signal connection 35 between control device 39 and a master axis encoder 42 that represents the press phase of the printing press and/or the printing substrate 02 feed rate and serves to control the squeegee, e.g., as master 42. Said master axis encoder may be constituted, for example, by a sensor system 42 that detects the relevant press phase of the printing press and/or the feed rate of printing substrate 02, and/or by a drive controller 42 that controls the indirect or direct driving of cylinder 21. In an embodiment that is particularly suitable for press retrofitting, this may be a sensor system 42 that is already provided in the press and is assigned to a component to be driven true-to-register, for example the feed drum. For presses in which multiple components or component groups relating to transport and/or printing are rotationally driven by mechanically independent drive motors via a common electronic master axis, the master axis encoder 42 that serves as master 42 for squeegee control is or may be formed by such an electronic master axis 42, which serves as master for a plurality of additional drive motors of the printing press. If such a master axis 42 is in the form of an actual electronic master axis 42, it can follow the rotational movement of an actual angle signal; if it is in the form of a virtual master axis, it can be generated by data processing means 39 and specified for all follow-on drives that are coupled to it. In that case, signal connection 35 is formed by the coupling to electronic master axis 42 and is embodied, for example, as a bus system or network system.

Squeegee device 33, more particularly said control device 39 that engages and disengages squeegee 34 in correlation to the press phase of the printing press and/or to the feed rate of printing substrate 02, comprises control means 43, with which a length and/or position of at least one phase $P_{ON}$ that relates to the engaged position "ON" is and/or can be varied within a recurring engagement and disengagement cycle, in dependence upon information I(F); I($L_B$); I(M) that relates to or represents the printing substrate format and/or the printing image. More particularly, the information I(F); I($L_B$); I(M) that relates to or represents the printing substrate format, in particular its length, and/or the printing image is information I(F); I($L_B$); I(M) regarding the printing substrate length L02 as viewed in the direction of transport, or regarding the printing image length $L_B$ in relation to the printing substrate sheets 02, or regarding the printing pattern to be printed by printing unit 19; 23. The length and position of the phase $P_{ON}$ can therefore stand both for the length as measured in the circumferential direction on the interior of the screen printing forme 31; 32 and for the temporal equivalent thereof as an interval of time or a chronology in relation to the circumferential speed.

In a first variant, for the format-dependent or printing image-dependent control of the phase length and/or phase position of two or more discrete values or value ranges for the relevant information I(F); I (L44); ($I_M$), a corresponding number of discrete phase lengths and/or phase positions for the phase $P_{ON}$, in which squeegee 34 is engaged, and/or a corresponding number of phase positions, e.g., spaced at least partially from one another, for the end of the phase $P_{ON}$ with squeegee 34 engaged may be stored in or provided by means of control means 43, for example.

In an alternative variant, however, dependent upon a value that is derived from a continuous range of values for the relevant information I(F); I($L_B$); I(M), the control means 43 can provide or supply a value for the phase length and/or phase position of the phase $P_{ON}$ with squeegee 34 engaged or for the phase position of the end of the phase $P_{ON}$ with squeegee 34 engaged from a continuous value range, which is limited, e.g., in terms of maximum and minimum. "Continuous" is also understood as a sequence of equidistant, discrete increments, determined, for example, by constraint or by rounding to the smallest increments to be considered and/or manipulated in the variable in question.

Control device 39 processes signals $S_K$ relating to the aforementioned correlation into signals $S_R$ for controlling the engaging and disengaging movement of squeegee 34, factoring in a specific phase length and/or phase position for the phase $P_{ON}$ or phases $P_{ON}$ relating to the engaged position "ON" within a cycle or a cycle length $L_Z$. The specific phase length and/or phase position is acquired and supplied by control means 43 dependent upon the printing substrate format, in particular its length, and/or upon information I(F); I($L_B$); I(M) that characterizes and/or relates to the printing image, in this case, for example, also combined under the umbrella designation of information I relating to the print run (see, e.g., FIG. 9).

The control means 43, contained, e.g., in control device 39 for the correlated, in particular synchronized drive, and configured for supplying the format- and/or printing image-dependent phase length and/or phase position, can in turn be formed by one or more integrated or distributed circuit and/or data processing means, the latter comprising circuit and/or data processing means for determining a phase length relating to the engaged position "ON" and/or the phase position, in dependence upon the aforementioned received information I(F); I($L_B$); I(M) relating to format and/or printing image.

The control means 43 contained in control device 39 may be wholly or partially integrated, depending upon the control device 39 itself, into a press control system that is connected in terms of control processes to other actuating and/or drive means of the printing press, e.g., to a planning and/or control level 47, or may be provided peripherally and in close proximity to the drive means 41 to be controlled.

The length and/or position of the at least one phase $P_{ON}$, in which squeegee 34 is engaged, or the corresponding or temporal arrangement or a movement profile that factors in this length or this time interval, is determined and/or provided based upon an assignment rule contained in control means 43, dependent upon the information I(F); I($L_B$); I(M) to be considered. The assignment rule may be provided in tabular form or as a functional correlation in a computing and/or storage means 52 contained in control means 43. This is also to be understood as a complex rule by which, dependent upon the information I(F); I($L_B$); I(M) to be considered, a movement profile that factors in the specific length and/or position is determined and/or created.

The information I(F); I($L_B$); I(M) that determines the phase length and/or the phase end or the phase position may be made available to control means 43, e.g., by the planning and/or control level 47, via a signal connection 45. This can be implemented, particularly in the case of information I(F); I($L_B$) that relates to or represents the printing substrate format F and/or the printing image, from a control console assigned to the planning and/or control level 47, for example. On said control console, the corresponding information I(F); I($L_B$) itself or details relating to this information I(F); I($L_B$) to be processed may be manually selected or input via an operator interface, for example. In a more automated form, the information I(F); I($L_B$) or the details relating to said information I(F); I($L_B$) to be processed are or can be obtained from data relating to product and/or production planning that are already available electronically in the planning and/or control level 47 or in a prepress stage. In one variant, which is preferable in particular when information I($L_B$); I(M) relating to the printing length or the printing pattern will be used, the relevant information I($L_B$); I(M) is or can be obtained from data that are already available in the prepress stage for the printing image segment in question.

Here, the term "phase length" or "phase position," unless otherwise expressly stated, as a short form for the aforementioned "length" or "position," is or can be understood as the size and the position, respectively, of the phase in question in terms of space (position, angle), and the temporal equivalent thereof, over the speed profile, is or can be understood as the interval of time or the relative position within the synchronized cycle length $L_Z$. The points in time for the phase change in each case, and thus the phase length and the phase position, are determined, e.g., in relation to the press phase position and/or in relation to the printing substrate phase position.

Figure 6A:
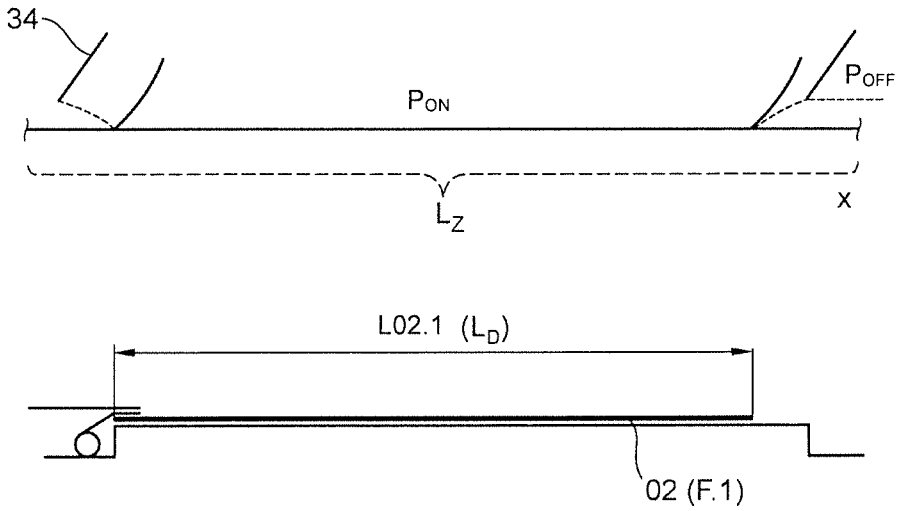
FIG. 6*a* shows a schematic diagram of the series of phases in a throw-on and throw-off sequence for a larger printing substrate format.
Figure 6B:
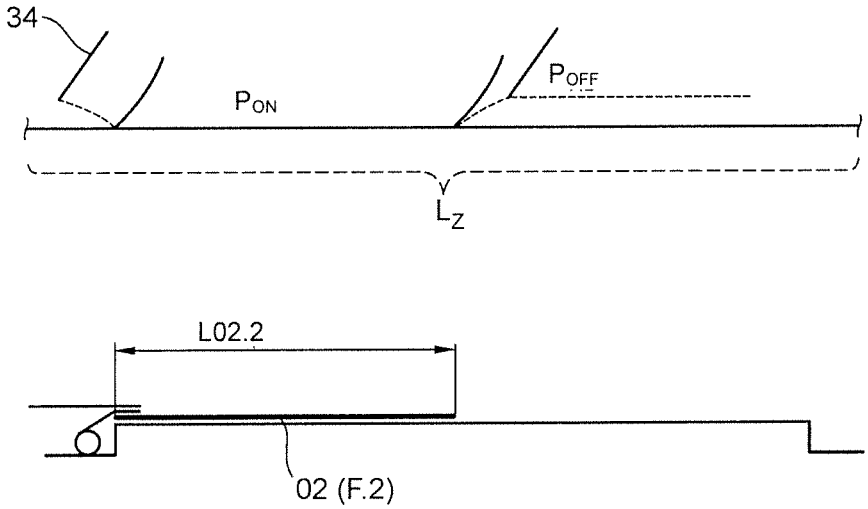
FIG. 6*b* shows a schematic diagram of the series of phases in a thrown-on and thrown-off sequence for a smaller printing substrate format.

In a first embodiment of the configuration of control means 43 or of the control of squeegee movement, illustrated schematically, e.g., in FIG. 6 in a view from the side of an unrolled cylinder shell comprising a usable circumferential section $U_D$, printing substrate sections of a first format F.1, i.e., having a first printing substrate length L02.1, are or can be printed in a first operating situation, for example, and printing substrate sections 02 of a second format F.2, i.e., having a second printing substrate length L02.1, are or can be printed in a second operating situation. Dependent upon the respective printing substrate length L02.1; L02.2 or upon information I(F) that represents said length, the phase length of the phase $P_{ON}$ in which squeegee 34 is engaged, or as is preferable in this case, the end of the phase $P_{ON}$ in which squeegee 34 is engaged, is determined by control device 39, and/or, dependent upon the respective printing substrate length L02.1; L02.2 or upon information I(F) that represents said length, squeegee 34 is engaged and disengaged in respective cycles Z1; Z2 (see, e.g., FIG. 5), in which phase lengths that differ from one another for the respective phase $P_{ON}$ with squeegee 34 engaged, or, as is preferable in this case, phase positions that differ from one another for the end of the respective phase $P_{ON}$ with squeegee 34 engaged, are or can be assigned to the different printing substrate lengths L02.1; L02.2. In this case, the phase position for the beginning of the respective phase $P_{ON}$ in which squeegee 34 is engaged can be specified in each case as the same and, for example, a fixed but optionally variable phase position. Said phase position can lie upstream of the beginning of the circumferential section $U_N$ that is usable for printing, as described above, for example.

Figure 7:
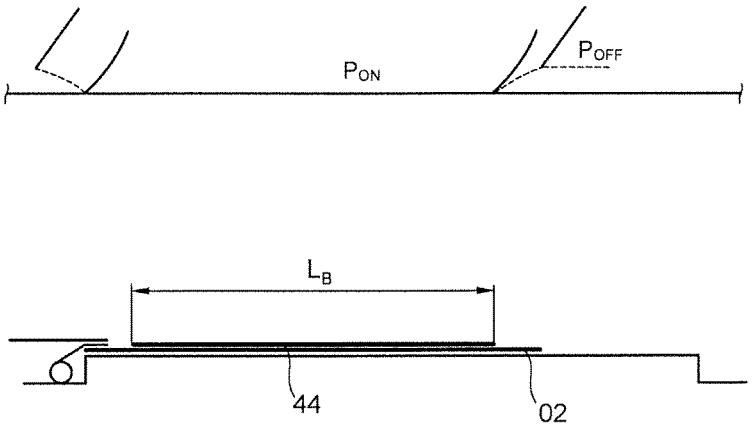
FIG. 7 shows a schematic diagram of the series of phases in a throw-on and throw-off sequence, dependent upon the position and length of the current printing image length ($L_B$)

In a second embodiment that may be implemented or provided in place of or as an alternative to the first embodiment, as illustrated schematically, e.g., in FIG. 7 in a view from the side of an unrolled cylinder shell comprising a usable circumferential section $U_D$, the phase length of the phase $P_{ON}$ in which squeegee 34 is engaged, or at least one end of the phase $P_{ON}$ with squeegee 34 engaged, is determined by control device 39 in dependence upon the respective printing image length $L_B$ or upon information $I(L_B)$ that represents said length. The printing image length $L_B$ is understood in this case, e.g., as the length that is limited on the leading side by the first application of ink, and on the trailing side by the last application of ink to be produced in print position 06; 07. The printing area 44 lying therebetween may contain continuous or discontinuous printing areas 44. For operating situations that involve different printing image lengths $L_B$, dependent upon the respective printing image length $L_B$ or upon information $I(L_B)$ that represents said length, squeegee 34 is engaged and disengaged in respective cycles Z1; Z2, in which phase lengths that differ from one another for the respective phase $P_{ON}$ in which squeegee 34 is engaged, or phase positions that differ from one another for the end of the respective phase $P_{ON}$ in which squeegee 34 is engaged, are or can be assigned to the different printing image lengths $L_B$. In this case, the phase position for the beginning of the respective phase $P_{ON}$ in which squeegee 34 is engaged may be the same, and, e.g., a fixed phase position, but is optionally a variable phase position. Said position may actually lie upstream of the beginning of the circumferential section $U_N$ that is usable for printing, as described above, for example. In that case, as above, the phase position for the beginning of the respective phase $P_{ON}$ in which squeegee 34 is engaged may be the same in each case, or may be a phase position that is dependent upon the beginning of the printing image.

Figure 8:
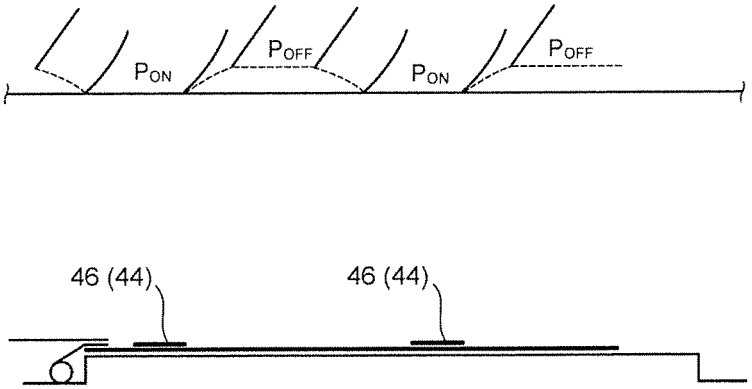
FIG. 8 shows a schematic diagram of the series of phases in a throw-on and throw-off sequence, dependent upon the position, length and number of printing strips in a current printing image length.

In a third embodiment that can be implemented or provided, optionally in place of or as an alternative to the first and/or second embodiments, as illustrated schematically, e.g., in FIG. 8 in a view from the side of an unrolled cylinder shell comprising a usable circumferential section $U_D$, for each cycle length $L_Z$ a plurality of phases $P_{ON}$ in which squeegee 34 is engaged and a plurality of phases $P_{OFF}$ in which squeegee 34 is disengaged may be provided. In this case, a beginning and an end of the respective phases $P_{ON}$ with squeegee 34 engaged are determined by control device 39 dependent upon information I(M) that represents the phase position, as viewed in the transport direction, of printing strips 46 of a printing area 44 that is interrupted by strips that will not be printed. For operating situations that have different patterns of strips to be printed and strips that will not be printed, an individual engagement and disengagement of squeegee 34, and depending upon the respective distribution of the printing strips 46 or upon information I(M) that represents said distribution, a plurality of engagements and disengagements of the squeegee are carried out in a respective cycle, in which different patterns for the phase positions and/or phase lengths, i.e., the position of the respective beginnings and ends of the respective phase $P_{ON}$ in which squeegee 34 is engaged, are or can be assigned to the printing areas 44 that differ from one another in terms of the distribution of printing strips 46. The information I(M) regarding the number and/or position of the printing strips 46 is based, for example, upon data that can be or are obtained by analyzing the printing image to be printed by print position 06; 07, in particular by analyzing the target printing image, which is present in the form of data, e.g., in the prepress stage. Strips that are to be printed, which are separated, e.g., by narrower strips that are not to be printed, are or can be combined to form larger printing strips 46, despite their discontinuity.

In conjunction with the first and second embodiments, in particular, the ratio between the phase length, in relation to the length of the traversed inner circumference of the screen printing stencil, of the phase $P_{ON}$, referring to the engaged position "ON", and that of the phase $P_{OFF}$, referring to the disengaged position "OFF", may be varied within the preferably fixed cycle length $L_Z$ by means of control means 43.

The bearing and drive device for squeegee 34, which enables the engaging and disengaging movement in the aforementioned embodiments, may generally have any configuration, provided it comprises preferably at least one squeegee 34 that can be correspondingly engaged and disengaged, and a drive 41, 48 that is and/or can be operated mechanically independently of the rotary drive of screen printing cylinder 18; 22 and/or of impression cylinder and/or transport cylinder 21. Said drive may be brought, for example, in particular without mechanical coupling to the drive of screen printing cylinder 18; 22 or of impression cylinder and/or transport cylinder 21, either to an operating state $BZ_{ON}$ that brings about the engaged position "ON" of squeegee 34 or to an operating state $BZ_{OFF}$ that brings about the disengaged position "OFF" of squeegee 34 (see, for example, FIGS. 5*b*) and 5*a*)).

Drive 41, 48, which is and/or can be operated mechanically independently of the rotary drive of screen printing cylinder 18; 22 and/or of impression cylinder and/or transport cylinder 21 and/or is configured without mechanical drive coupling to the rotary drive of screen printing cylinder 18; 22 and/or impression cylinder and/or transport cylinder 21, can generally have any desired configuration, provided it will enable squeegee 34 to be engaged and disengaged in the manner described. The nature of the movement of squeegee 34 and/or the configuration of the drive may generally have any desired configuration. The following examples reflect particularly advantageous embodiments, but are not necessarily intended as a restriction of the underlying functional solution.

A drive 41, 48 of this type comprises at least one controllable drive means 41. Said drive means may be configured, for example, as a drive means 41 that is actuated by pressurized fluid, such as, e.g., a cylinder/piston system that can be acted on by pressurized fluid, for example, a hydraulic or pneumatic cylinder drive, or, as is preferred in this case, as a preferably angular position controllable motor 41, such as, e.g., an electric motor 41, for example as a linear motor or as a rotary electric motor 41.

On the output side, drive means 41 is operatively connected directly or indirectly via a corresponding coupling to the squeegee 34 to be moved. The operative connection may act on squeegee 34 directly, without any type of transmission, or via a transmission 48.

In a first embodiment, a transmission of this type may be formed, e.g., by a transmission 48 that converts a linear movement of a linearly acting drive means 41, e.g., a drive means 41 that can be actuated by a pressurized fluid, to an engaging/disengaging movement of squeegee 34, for example, comprising a tappet and/or a one-armed or two-armed lever. In another advantageous embodiment of the drive, coupling may be achieved or implemented via a transmission 48 that converts a rotational movement of a rotary drive means 41, e.g. an electric motor 41, to an engaging/disengaging movement of squeegee 34. In a third, advantageous embodiment, the drive may be embodied as a linear drive, and the transmission 48 as a transmission 48, e.g. a spindle gear, that converts a rotational movement of a preferably angular position-controlled rotor of an electric motor 41 to a linear movement of a carrier that carries the squeegee 34.

In screen printing, a print-on "DN" setting at the nip point 06; 07 may also generally be implemented in that, with the movement of the squeegee 34 into its engaged position "ON", the screen printing forme 31; 32 in the form of a round screen, which is elastic and/or deformable within certain limits, is moved from a position spaced from the lateral surface 27 into physical contact with impression cylinder 21. In an embodiment that is preferred here, screen printing forme 31; 32 and squeegee 34 can be moved into engagement independently of one another. For movement between the print-on "DN" and print-off "DB" settings of screen cylinder 18; 22, another drive means 49, different from the aforementioned drive means 41, e.g., a motor 49, in particular electric motor 49, or a pressurized medium-actuated drive means 40, such as a pneumatic cylinder 49, is provided. Said drive means may be embodied, for example, as a drive means 41 that is actuable by means of pressurized fluid, e.g. a hydraulic or pneumatic cylinder, as an electric motor, or some other embodiment.

In addition to control device 39, by means of which squeegee 34 is or can be engaged and disengaged in the aforementioned correlation to the press phase of the printing press and/or to the feed rate of the printing substrate 02, and, for example, a master 42 that supplies the printing substrate feed rate and/or the machine phase position, control means 51 are provided, by means of which the screen cylinder 18; 22 is thrown on and off via the appropriate actuation of the drive means 41, for example, by control means 51 supplying a corresponding signal to drive means 49. In one potentially advantageous embodiment, the entire actuating mechanism for squeegee 34 is moved along with the screen cylinder 18; 22 during the positioning thereof. This prevents the screen printing forme 31; 32 from being pressed against squeegee 34, which may otherwise remain stationary, when screen cylinder 18; 22 is thrown off, for example.

Control means 51 may also send a signal to control device 39 to control squeegee operation. Said signal may be used, for example, to activate and deactivate a perpetual engagement or the cyclical engagement described above.

In particular, the embodiment in which the engagement and disengagement of squeegee 34 and the throwing-on and throwing-off of screen printing cylinder 18; 22 can be implemented independently of one another enables a particularly preferable operating mode of printing unit 19; 23 to be implemented during the startup or restarting of the press or of printing unit 19; 23. This is intended to largely prevent, or at least significantly reduce, soiling of the surface of impression cylinder 21 with printing ink coming out of screen cylinder 31; 32. Particularly in situations in which the screen cylinder still or already contains printing ink but no ink has been removed by the printing substrate 02 to be printed, printing ink that seeps through may accumulate on the outer surface of the screen, which can subsequently lead to deposits of ink on the lateral surface 27 of the impression cylinder 21 and to damage or at least to substantial effort for cleaning of said surface.

Printing ink that has already been introduced into screen cylinder 18; 22 for an upcoming production process or that is left there during an interruption in production can seep through the pores, for example. This is the case especially if the screen cylinder 18; 22, which has not yet been thrown on or is still thrown off, is rotating with the squeegee 34 in a disengaged position. Even more of the printing ink is pressed through the pores by centrifugal force.

When the printing ink that undesirably accumulates on the outer surface builds up, e.g., over multiple revolutions, for example over more than three revolutions, it can reach a layer thickness greater than the gap width that is formed in the print-off setting DB, so that it can at least partially reach the lateral surface 27 of impression cylinder 21. At the start of printing, i.e., once screen cylinder 18; 22 has been moved to the print-on position and squeegee 34 has been engaged, an ink roll can also form on the screen outer surface, which in the worst case cannot be picked up by printing substrate 02 and is transported to the end of the sheet. There, the residual ink is distributed onto the surface of impression cylinder 21. Such ink smudges on impression cylinder 21 are particularly disadvantageous in the aforementioned case in which a drying device 36, in particular an interdeck dryer 36, is directed toward lateral surface 27 and, for example, cannot be deactivated for the startup process.

To prevent such soiling, the startup or resumption of printing, or the continuation of printing following an error-induced throwing on of screen cylinder 18; 22, involves the following steps:

Proceeding from an operating situation referred to here as the first phase, in which screen cylinder 18; 22 is thrown off of impression cylinder 21 and squeegee 34 is in a disengaged position, in a subsequent, e.g., second phase, in which squeegee 34 remains in a disengaged position, one or more printing substrate sheets 02 are conveyed through print position 06; 07 with screen cylinder 18; 22 thrown on at least temporarily, preferably for each printing substrate sheet 02. If the above-described openings 28 are provided in the lateral surface 27 of impression cylinder 21, screen cylinder 18; 22 can be lifted off in the area of the openings 28 and then thrown on again. Finally, in a subsequent, e.g., third phase, for subsequent printing substrate sheets 02, an operation is carried out in which squeegee 34 is engaged perpetually or preferably cyclically in the manner described above at least once for each printing substrate sheet 02. In contrast to operation without a squeegee 34, squeegee operation in the latter phase is meant to be just as effective as a perpetually engaged squeegee 34. In general, during or at least toward the end of the first phase, screen cylinder 18; 22 still or already contains printing ink, producing the risk of the aforementioned soiling.

Therefore, the throw-on sequence of screen cylinder 18; 22 and squeegee 34 is carried out such that at first, for one or more revolutions, only the screen is thrown on. During this time, printing ink on the outer surface of screen printing forme 31; 32 is transferred to printing substrate 02. Then, when squeegee 34 is engaged, there is only as much printing ink on the outer surface of screen printing forme 31; 32 as the volume of ink that can be picked up by printing substrate 02, and a bead of ink can no longer build up in the nip point 06; 07. This procedure may result in a greater number of wasted sheets at the start of printing, however it helps to reduce or avoid time-consuming processes of cleaning impression cylinder 21.

In the second phase, one or more printing substrate sheets 02 is/are preferably conveyed through the print position 06; 07 with screen cylinder 18; 22 thrown on at least temporarily for each sheet, while squeegee 34 remains disengaged for the period of time required for this.

In particular, in the second phase two to nine, preferably two to six printing substrate sheets 02 are conveyed in this manner through print position 06; 07 with screen cylinder 18; 22 thrown on at least temporarily for each sheet, while squeegee 34 remains disengaged for the period of time required for this, i.e., the squeegee is not and will not be engaged perpetually or cyclically.

The printing substrate sheets 02 that are conveyed during the second phase through print position 06; 07 while squeegee 34 remains in a disengaged position are preferably separated from the good sheets as waste sheets, in particular are ejected and/or collected separately, downstream of screen printing unit 19; 23.

In one advantageous embodiment, a fixed but preferably predefinable number of at least one, in particular a number of one to three first printing substrate sheets 02 conveyed through print position 06; 07 in the third phase, with squeegee 34 engaged and with screen cylinder 18; 22 thrown on, are separated from the good sheets as waste sheets, in particular are ejected and/or collected separately, regardless of their quality.

In a first variant of the starting position in the first phase, screen cylinder 18; 22 and/or impression cylinder 21 is in an idle state, and is then accelerated in a startup phase occurring between the first and second phases to an operating speed, and is operated at this operating speed, at least for a time. This starting position exists, for example, if, according to plan or as a result of an error, an interruption in production occurs in which, for example, the press is powered down to an idle state.

In a possible second variant of the starting position, screen printing cylinder 18; 21 could be thrown off for a shorter period of time, for example, without the press and/or screen cylinder 18; 22 actually being brought to an idle state. In cases in which the speed after the screen cylinder 18; 22 has been thrown off is initially higher than a desired low operating speed, this initial speed is reduced to the lower operating speed during a braking phase occurring between the first and second phases, after which operation is continued, at least for a time, at the lower operating speed that may already exist or is reached following the reduction in speed.

Said lower operating speed existing or achieved in the second phase is significantly lower, i.e., by at least one-third of the target production speed, than the target production speed. It corresponds, for example, at most to a sheet feed rate through print position 06; 07 of up to 4,000 sheets/hour, in particular of 2,000 to 4,000 sheets/hour.

During the second and/or third phases, screen cylinder 18; 22 and/or impression cylinder 21 is preferably accelerated to a target production speed that is at least 1.5 times greater than the lower operating speed previously assumed and/or that corresponds at least to a sheet feed rate through print position 06; 07 of at least 6,000 sheets/hour.

For applications in which operation comprising the first, second, and third phases is carried out as part of a commencement or resumption of a production run, a feeding of sheets into the printing press is preferably started by sheet feeder 01 between the first and second phases, in synchronization with the angular position and/or rotational speed of impression cylinder 21, with the second phase beginning when screen cylinder 18; 22 is thrown onto a printing substrate sheet 02, e.g., the first such sheet that is conveyed from sheet feeder 01 into print position 06; 07 as part of a commencement or resumption of production.

Preferably, when the press is started for a commencement or a resumption of operations, the number of press revolutions, in particular at least the number of screen cylinder revolutions, is reduced to a minimum before the first printing substrate sheet 02 is printed. Additionally, the press speed is preferably increased to the production speed only after the start of printing, i.e., after screen cylinder 18; 22 and squeegee 34 have been thrown on. Thus, in a shorter time with the least possible centrifugal force, less printing ink is forced from the inside to the outside through screen printing forme 31, 32.

A resumption of production is preceded, for example, by an error-induced interruption in production and a machine stop in which shutdown is controlled. When an error, e.g., a feed error in sheet feeder 01, is detected, e.g., the press speed, in particular the speed of the screen printing cylinder and/or impression cylinder 18; 21; 22, is decreased from the production speed to an operating speed that is reduced significantly therefrom, i.e., by at least one-third of the target production speed, and/or that corresponds at most to a sheet feed rate through print position 06; 07 of up to 4,000 sheets/hour. The further infeed of printing substrate sheets 02 by sheet feeder 01 is halted, for example. Printing sheets 02 that are already in the transport path of the printing press, e.g., a number of two to fifteen, are still conveyed through print position 06; 07 and, at the reduced operating speed, to product delivery 04. Once the last printing substrate sheet 02 has been deposited in product delivery 04, the press can be fully stopped.

Squeegee 34 is preferably moved to a disengaged position before screen printing cylinder 18; 22 is thrown off. Although there may be only a few seconds or even tenths of a second between these steps, in a further refinement it may be advantageous for screen printing cylinder 18; 22 to be thrown off only after it has rolled with at least a majority, e.g., more than two-thirds, of its circumference along a printing substrate sheet 02 that is conveyed through print position 06; 07, with squeegee 34 in a disengaged position.

For a planned or controlled press stop (for example, at the end of production or during an interruption in production, possibly due to error, e.g., system error, or according to production plan), the press speed is thus preferably reduced as much as possible while squeegee 34 is engaged, especially during the last printing substrate sheet 02. The transport of sheets from the printing nip to the delivery takes place at a reduced operating speed. This ensures that, with decreased centrifugal force, less printing ink is forced from the inside to the outside through screen printing forme 31; 32.

Although for operation of the squeegee in the stated method, a perpetual engagement, or a cyclical engagement and disengagement coupled mechanically to the angular position of the impression cylinder may be provided, the above-described engagement and disengagement of squeegee 34 by a drive means 41 that is mechanically independent of the rotary drive is preferably used for the squeegee drive.

The procedure may be applied likewise to a drive of the printing press and/or the screen printing unit in which cylinders 18; 21; 22 are driven jointly via a drive coupling, and to an embodiment comprising cylinders 18; 21; 22 that are driven individually or in groups. In one advantageous embodiment, for example, screen printing cylinder 18; 22 can be driven independently of impression cylinder 21, so that during shutting down of the press with screen printing cylinder 18; 22 already thrown off, the lag running time of the screen printing cylinder can be shortened, and/or during startup of the press with screen printing cylinder 18; 22 still thrown off, the lead time of the screen printing cylinder can be shortened. This also enables allows soiling to be reduced.

The device for operating a screen printing unit 19; 23 in the manner described above comprises the aforementioned control means 51, which, following a first phase in which screen cylinder 18; 22 is thrown off of impression cylinder 21 and squeegee 34 is in a disengaged position, in a second phase, in which squeegee 34 is perpetually disengaged, throws the screen cylinder on at least temporarily for each printing substrate sheet 02 during the passage or one or more printing substrate sheets 02 through print position 06; 07, and in a subsequent third phase, in particular the production phase, for a number of substrate sheets 02, in particular a plurality of such sheets, e.g. more than 20, said control means engages squeegee 34 from the inside against screen printing forme 31; 32, perpetually or at least once for each printing substrate sheet 02. The device and/or control means 51 is configured appropriately for this purpose, i.e., comprising a control routine, which is implemented, for example, as a software program in data processing means that are contained in control means 51.

While a preferred embodiment of a method and a device for operating a rotary screen printing press, in accordance with the present invention, has been set forth fully and completely herein above, it will be apparent to one of skill in the art that various changes could be made thereto, without departing from the true spirit and scope of the present invention, which is accordingly to be limited only by the appended claims.

The invention claimed is:

1. A method for operating a screen printing unit in a printing press comprising a screen cylinder, which carries a screen printing forme and in which a squeegee can be engaged, from the inside, against the screen printing forme and disengaged therefrom, and which screen cylinder can be thrown onto an impression cylinder, such that a print position is formed, and can be thrown off of said impression cylinder such that a gap is formed, wherein, in a first phase, the screen cylinder is thrown off of the impression cylinder while the squeegee is in a disengaged position, in a second phase, multiple printing substrate sheets are conveyed through the print position while the squeegee remains in a disengaged position, and the screen cylinder is at least temporarily thrown on, and, in a third phase, for subsequent printing substrate sheets, an operation is carried out in which the squeegee is in an engaged position, one of perpetually and cyclically at least once for each printing substrate sheet.

2. The method according to claim 1, characterized in that, in the second phase, multiple printing substrate sheets are conveyed through the print position, with the screen cylinder being thrown on at least temporarily for each sheet, while the squeegee remains in a disengaged position for the period of time required for this second phase.

3. The method according to claim 2, characterized in that, in the second phase, two to nine, printing substrate sheets are conveyed through the print position with the screen cylinder thrown on at least temporarily for each sheet, while the squeegee remains in a disengaged position for the period of time required for this second phase.

4. The method according to claim 1, characterized in that one of during and at least toward an end of the first phase, printing ink is located inside the screen cylinder, and one of the screen cylinder and the impression cylinder is in an idle state in the first phase, is accelerated to an operating speed in a startup phase between the first and the second phases, and is operated at this operating speed, at least for a time.

5. The method according to claim 1, characterized in that the printing substrate sheets conveyed through the print position in the second phase, while the squeegee remains in a disengaged position, are separated from the good sheets as waste sheets, and one of are ejected and are collected separately, downstream of the screen printing unit.

6. The method according to claim 1, characterized in that a fixed number of first printing substrate sheets, conveyed through the print position in the third phase, with the squeegee in an engaged position and the screen cylinder thrown on, are separated from good sheets as waste sheets, and one of are ejected and are collected separately, regardless of their quality.

7. The method according to claim 6, characterized in that an operating speed, one of existing and reached in the second phase, is significantly lower than a target production speed and is one of at least one-third lower than the target production speed, and equal to a sheet feed rate through the print position of up to 4,000 sheets/hour.

8. The method according to claim 1, characterized in that, during one of the second phase and the third phase, one of the screen cylinder and the impression cylinder is accelerated to a target production speed that is at least 1.5 times greater than one of a lower operating speed previously assumed and that is equal to a sheet feed rate through the print position of at least 6,000 sheets/hour.

9. The method according to claim 1, characterized in that the operation comprising the first, second, and third phases is carried out as part of one of a commencement and a resumption of a production run.

10. The method according to claim 9, characterized in that between the first and second phases, a sheet feeder begins feeding sheets into the printing press in synchronization with one of an angular position and an angular speed of the impression cylinder, and the second phase begins when the screen cylinder is thrown onto the first printing substrate sheet that is conveyed from the sheet feeder into the print position as part of one of a commencement and the resumption of a production run.

11. The method according to claim 9, characterized in that the resumption of a production run is preceded by an error-induced interruption in the production run, and a machine stop, in which shutdown is controlled.

12. The method according to claim 11, characterized in that the squeegee is moved to a disengaged position before the screen cylinder is thrown off.

13. The method according to claim 12, characterized in that the screen cylinder is thrown off, after the screen cylinder has rolled, with at least a majority of its circumferential surface, along a printing substrate sheet that is conveyed through the print position while the squeegee is in a disengaged position.

14. The method according to claim 1, characterized in that, during operation, in which the squeegee is engaged cyclically at least once per printing substrate sheet, one of an engagement and a disengagement of a squeegee against a screen printing forme is carried out in a repeating cycle comprising one of in a sequence of one or more phases relating to an engaged position and one or more phases relating to a disengaged position, and in that the squeegee is engaged and disengaged by a drive means that is mechanically independent of a rotary drive of one of the screen cylinder and the impression cylinder.

15. A device for operating a screen printing unit in a printing press, for use in a method according to claim 1, comprising a screen cylinder, which carries a screen printing forme and in which a squeegee can be engaged from the inside against the screen printing forme and can be disengaged from said printing forme by a first drive means, and which screen cylinder can be thrown, by a second drive means, which is different from the first drive means, onto an impression cylinder such that a print position is formed and which screen cylinder can be thrown off of said impression cylinder, such that a gap is formed, wherein a control means is provided, which control means is connected, in terms of signals, to the first and second drive means, and, after a first phase, in which the screen cylinder is thrown off of the impression cylinder and the squeegee is in a disengaged position, in a second phase, in which the squeegee is perpetually in a disengaged position during the passage of multiple printing substrate sheets through the print position, said control means actuates the second drive means to throw the screen cylinder on, at least temporarily, for each printing substrate sheet and, in a subsequent third phase, for a number of printing substrate sheets, said control means actuates the first drive means to engage the squeegee from the inside against the screen printing forme, one of perpetually and at least once for each printing substrate sheet.

16. The device according to claim 15, characterized in that one of the device and the control means is configured such that after a first phase, in which the screen cylinder is thrown off of the impression cylinder, and the squeegee is in a disengaged position, in a second phase, in which the squeegee is in a perpetually disengaged position, during the passage of one or more printing substrate sheets through the print position said control means throws said screen cylinder on at least temporarily for each printing substrate sheet, and in a subsequent third phase, said control means engages the squeegee, from the inside, against the screen printing forme, perpetually for one of a number of subsequent printing substrate sheets and at least once for each printing substrate sheet.

* * * * *